United States Patent [19]

Kato et al.

[11] Patent Number: 4,656,126

[45] Date of Patent: Apr. 7, 1987

[54] HEAT-DEVELOPABLE COLOR LIGHT-SENSITIVE MATERIAL

[75] Inventors: Masatoshi Kato; Hiroshi Kitaguchi, both of Kanagawa, Japan

[73] Assignee: Fuji Photo Film Co., Ltd., Kanagawa, Japan

[21] Appl. No.: 711,885

[22] Filed: Mar. 14, 1985

[30] Foreign Application Priority Data

Mar. 14, 1984 [JP] Japan ..... 59-48305

[51] Int. Cl.[4] ..... G03C 1/40; G03C 1/06

[52] U.S. Cl. ..... 430/559; 430/351; 430/353; 430/562; 430/955; 430/617; 430/619; 430/620; 430/203

[58] Field of Search ..... 430/955, 619, 620, 203, 430/617, 559, 351, 353, 562

[56] References Cited

U.S. PATENT DOCUMENTS

| | | | |
|---|---|---|---|
| 4,374,921 | 2/1983 | Frenchik | 430/619 |
| 4,499,180 | 2/1985 | Hirai et al. | 430/619 |
| 4,500,626 | 2/1985 | Naito et al. | 430/559 |
| 4,535,056 | 8/1985 | Frenchik | 430/619 |

FOREIGN PATENT DOCUMENTS

| | | | |
|---|---|---|---|
| 2815110 | 10/1978 | Fed. Rep. of Germany | 430/619 |

*Primary Examiner*—Won H. Louie

*Attorney, Agent, or Firm*—Sughrue, Mion, Zinn, Macpeak & Seas

[57] ABSTRACT

A heat-developable color light-sensitive material is described, comprising a support having thereon at least (1) a light-sensitive silver halide emulsion, (2) a dye providing substance which releases a dye having a different diffusibility from that of the dye providing substance in correspondence or countercorrespondence to the light-sensitive silver halide when the light-sensitive silver halide is reduced under the condition of high temperature and (3) an organic acid precursor containing a structural moiety bonded to carbon atoms that is represented by formula (I)

(I)

The heat-developable color light-sensitive material can provide color images having a high S/N ratio and a high image density.

18 Claims, No Drawings

HEAT-DEVELOPABLE COLOR LIGHT-SENSITIVE MATERIAL

FIELD OF THE INVENTION

The present invention relates to a heat-developable color light-sensitive material which provides stable photographic properties after development processing.

BACKGROUND OF THE INVENTION

Photographic processes using silver halide have been most widely used in the past for general photographic purposes, due to their excellent photographic properties such as sensitivity, control of gradation, etc., as compared with other photographic processes, such as an electrophotographic process or a diazo photographic process. In recent years, with respect to image formation processes for light-sensitive materials using silver halide, many techniques capable of easily and quickly obtaining images have been developed by changing from the conventional wet process using a developing solution to a dry development process, such as a process using heat, etc.

Heat-developable light-sensitive materials are known in the field of these techniques. Heat-developable light-sensitive materials and processes therefor have been described, for example, in *Shashin Kogaku no Kiso* (The Foundation of Photographic Technology), pages 553 to 555 (published by Corona Co., 1979); *Eizo Jyoho* (The Image Information), page 40 (April, 1978), *Neblette's Handbook of Photography and Reprography,* 7th Ed., pages 32 to 33 (Van Nostrand Reinhold Company), U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (September, 1975), and the combination of a sulfonamidophenol type reducing agent and a 4-equivalent coupler as described in U.S. Pat. No. 4,021,240.

Also, processes for forming a positive color image by a heat-sensitive silver dye bleach process, and useful dyes and methods for bleaching have been described, for example, in *Research Disclosure,* No. 14433, pages 30 to 32 (April, 1976), ibid., No. 15227, pages 14 and 15 (December, 1976), U.S. Pat. No. 4,235,957, etc.

Further, processes for forming-images upon heat-development utilizing compounds having a dye moiety and capable of releasing a mobile dye in correspondence or countercorrespondence to the reduction reaction of silver halide to silver under condition of high temperature have been described, for example, in European Patent Published Application Nos. 76,492 and 79,056, Japanese Patent Application (OPI) Nos. 28928/83, 26008/83, etc. (the term "OPI" as used herein refers to a "published unexamined Japanese patent application").

With these heat-developable light-sensitive materials the development is conducted by heating. However, light-sensitive materials once heated to a high temperature take much time to decrease their temperature, tending to result in overdevelopment and deterioration of the image quality. Further, it is possible for development proceeding to occur beyond a level, depending on subtle variations in conditions such as ambient temperature, heating temperature, moisture content of the light-sensitive material, time for heating, etc., even when the same pattern of heating is employed.

In order to eliminate such phenomena, it has been proposed to use compounds which react with alkalis to release development stopping agents as described in U.S. Pat. No. 4,009,029, and acid polymers for neutralization as disclosed in *Research Disclosure,* Vol. 123, page 22 and Vol. 180, page 18030 and British Pat. No. 2,082,787A. In heat-developable light-sensitive materials, however, the former do not effectively stop development, and the latter cause a reduction in the density of the image obtained because the bases are rapidly neutralized.

The most effective development-stopping means conceivable is to perform development in the presence of a compound which releases an acid at an appropriate time during development to neutralize the base which promotes development, thus stopping development. Very few compounds are known, however, which release acids when heated. For example, Japanese Patent Application (OPI) Nos. 58642/74 and 57452/75 describe acid components which at a temperature of at least 60° C. are dissolved, or release volatile acids. Since, the compounds disclosed in these patent applications neutralize the bases before heat development is started, development is inhibited and the density of the images obtained is reduced.

SUMMARY OF THE INVENTION

It is an object of the present invention to provide a novel heat-developable color light-sensitive material which has the effect of stopping development at an appropriate time of development without reducing the density of an image.

More specifically, this object is to provide a heat-developable color light-sensitive material containing a novel acid precursor which is very stable at temperatures below 50° C., and when it is heated above a certain temperature and the development proceeds, releases an acid to neutralize the base and stop the development.

Another object of the present invention is to provide a heat-developable light-sensitive material which can provide an image having a high S/N ratio, i.e., high maximum density and low minimum density, and a high density.

Other objects of the present invention will become apparent from the following detailed description and examples.

These objects of the present invention can be achieved by a heat-developable color light-sensitive material comprising a support having thereon at least (1) a light-sensitive silver halide emulsion, (2) a dye providing substance which releases a dye having a different diffusibility from that of the dye providing substance in correspondence or countercorrespondence to the light-sensitive silver halide when the light-sensitive silver halide is reduced under high temperature conditions, and (3) an organic acid precursor having a structural moiety bonded to carbon atoms that is represented by formula (I).

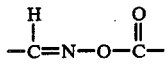

(I)

DETAILED DESCRIPTION OF THE INVENTION

Preferred organic acid precursors according to the present invention include represented by formula (A)

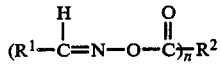

(A)

wherein $R^1$ represents a substituent selected from an alkyl group, a substituted alkyl group, a cycloalkyl group, an aralkyl group, an alkenyl group, an aryl group, a substituted aryl group, and a heterocyclic group; $R^2$ represents a mono-, di- or tri-valent residue selected from an alkyl group, a substituted alkyl group, a cycloalkyl group, an aralkyl group, an aryl group, a substituted aryl group, and a heterocyclic group; and n represents an integer of 1, 2, or 3.

Preferred alkyl groups represented by $R^1$ and $R^2$ are straight chain or branched chain alkyl groups containing from 1 to 18 carbon atoms. Specific examples include an ethyl group, a n-propyl group, a n-butyl group, a n-hexyl group, a n-heptyl group, a 2-ethylhexyl group, a n-decyl group, and a n-dodecyl group. Substituents on the substituted alkyl group include, for example, a halogen atom, an alkoxy group, a cyano group, a substituted or unsubstituted carbamoyl group, a hydroxyl group, and a carboxyl group.

Preferred cycloalkyl groups represented by $R^1$ and $R^2$ are a 5-membered or 6-membered cycloalkyl groups containing from 5 to 10 carbon atoms. Specific examples include a cyclopentyl group and a cyclohexyl group. Specific examples of the aralkyl groups include a benzyl group, a $\beta$-phenethyl group, etc. Specific examples of the alkenyl groups include a vinyl group, an allyl group, a crotyl group, and a substituted or unsubstituted styryl group.

Preferred aryl groups represented by $R^1$ and $R^2$ are groups containing from 6 to 18 carbon atoms. Specific examples include a phenyl group, a naphthyl group, and an anthryl group. Substituents on the substituted aryl group include, for example, a substituted or unsubstituted alkyl group, a substituted or unsubstituted alkoxy group, a substituted or unsubstituted aryl group, a halogen atom, a disubstituted amino group substituted with alkyl or aryl groups, an acylamino group, a sulfonylamino group, a cyano group, a nitro group, an alkyl- or arylthio group, an alkyl- or aryl-sulfonyl group, an oxycarbonyl group, a carbonyloxy group, a substituted or unsubstituted carbamoyl group, and a substituted or unsubstituted sulfamoyl group.

Specific examples of $R^1$ and $R^2$ heterocyclic groups include a pyridyl group, a furyl group, a thienyl group, a pyrrole group, and an indolyl group. The heterocyclic group may be substituted with the substituents defined for the above described substituted aryl group.

Of the above-described substituents for $R^1$ and $R^2$, an aryl group, a substituted aryl group and a heterocyclic group are preferred, and a phenyl group, a substituted phenyl group, a naphthyl group, and a substituted naphthyl group are particularly preferred.

When heated, the acid precursor according to the present invention releases a carboxylic acid derivative in accordance with the following reaction scheme.

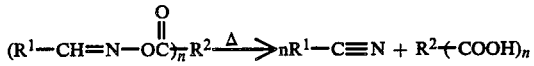

It is known that when an aldoxime derivative (B) is heated with an acid anhydride ($Ac_2O$), the corresponding nitrile (C) is formed.

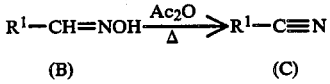

It has now been found for the first time that the compound represented by formula (A) which is an intermediate of this reaction, can be easily isolated, and it acts as an effective acid precursor which is stable at room temperature, and, when heated, releases an acid. The high temperature required for acid release is from 80° C. to 180° C., and preferably from 100° C. to 150° C. The rate of the reaction can be adjusted by a factor of more than 100 times by varying $R^1$ and $R^2$.

Specific examples of the acid precursor according to the present invention are shown below. The present invention, however, is not to be construed as being limited to these specific examples.

(1)

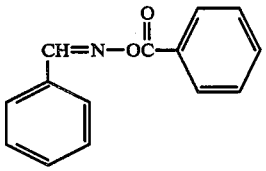

(2)

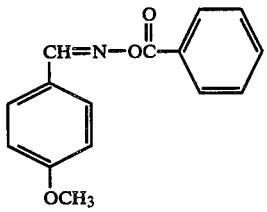

(3)

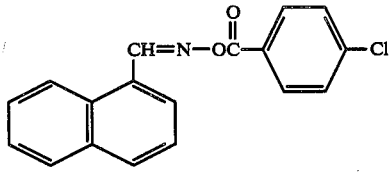

(4)

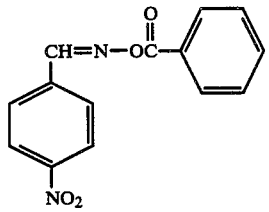

-continued
(5)
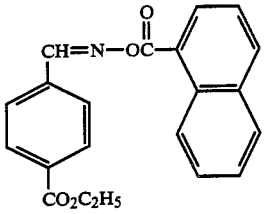
(6)
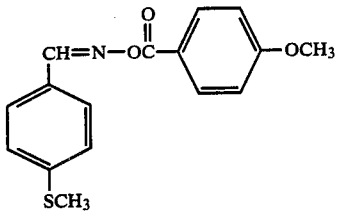
(7)
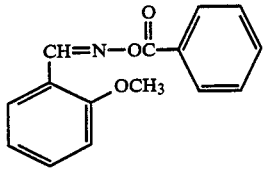
(8)
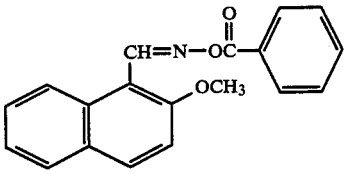
(9)
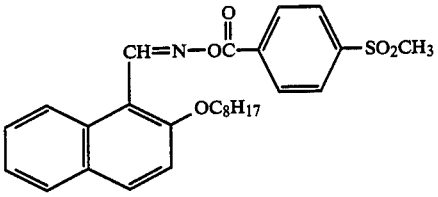
(10)
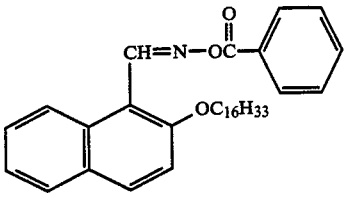
(11)
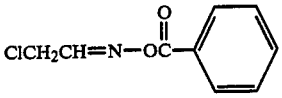
(12)
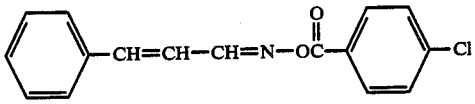
(14)
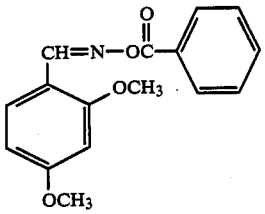
(15)
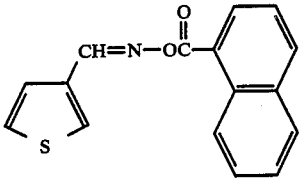
(16)
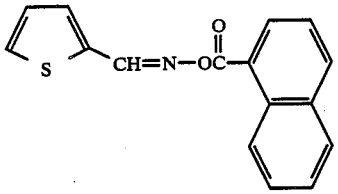
(17)
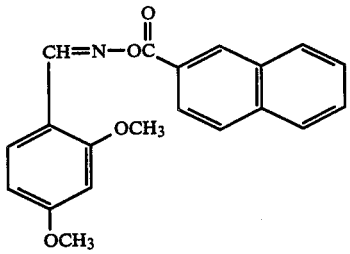
(18)
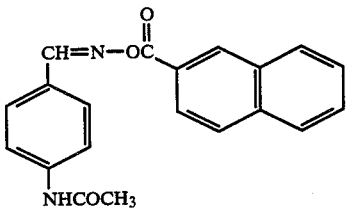
(19)
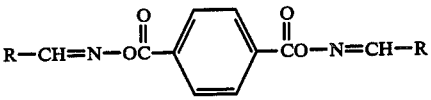
wherein: R— is 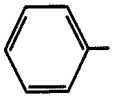
Compound of (19) wherein: (20)
Compound of (19) wherein: (21)

-continued
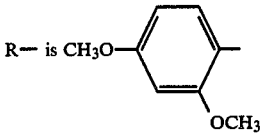
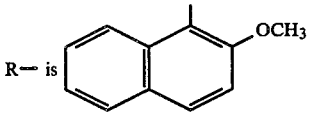
(22)
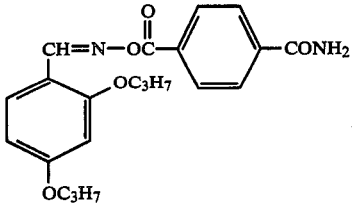
(23)
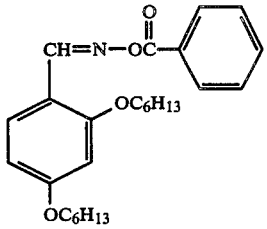
(24)
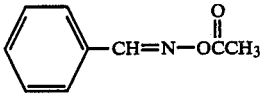
(25)
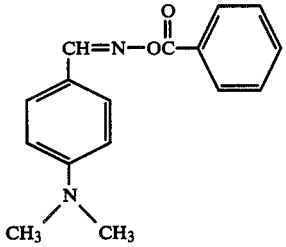
(26)
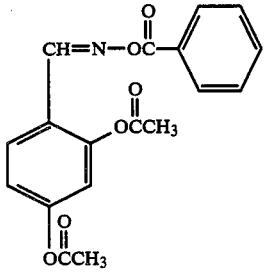
(28)
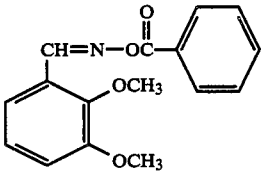
(29)
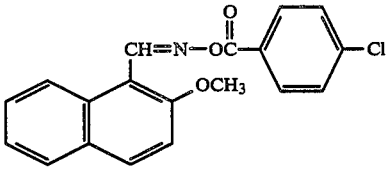
(30)
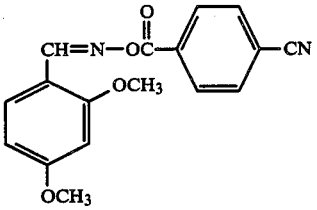
(31)
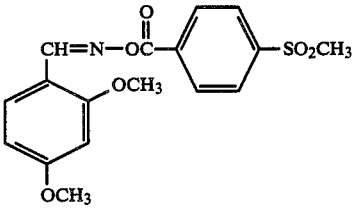
(32)
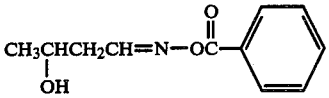
(33)
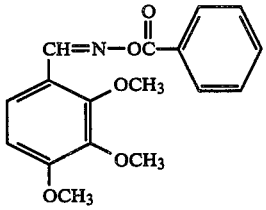
(34)
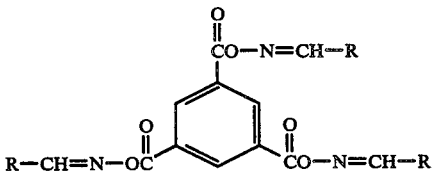

-continued
wherein: R— is 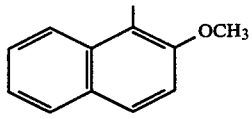
Compound of (34) wherein: R— is 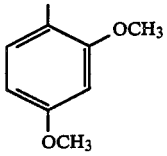
(35)
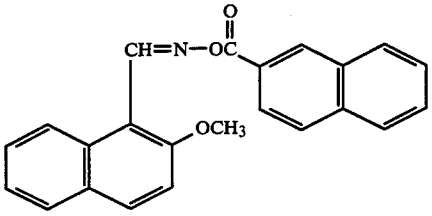
(36)
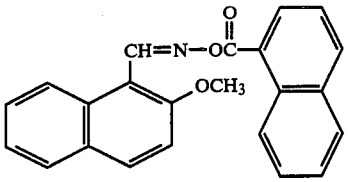
(37)
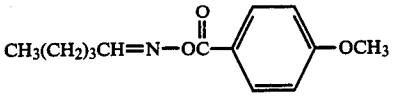
(38)
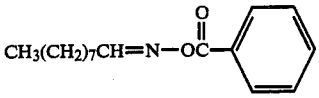
(39)
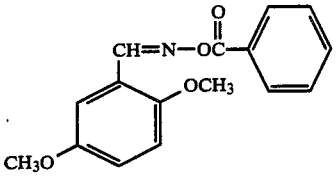
(40)
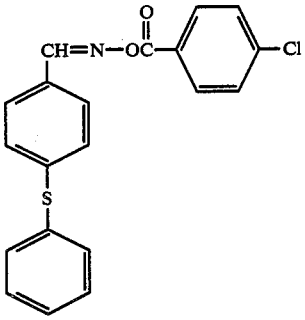
(41)
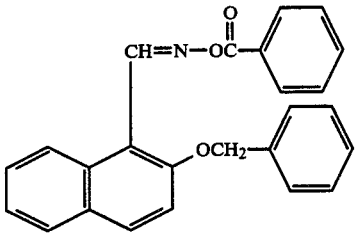
(42)
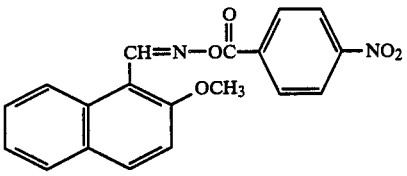
(43)
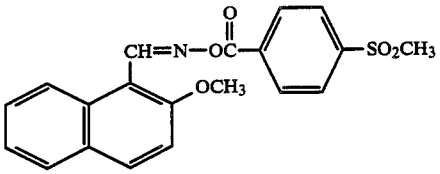
(44)
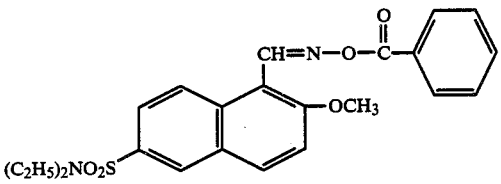
(45)
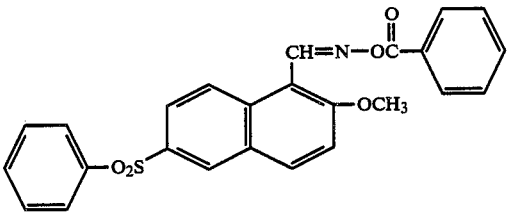
(46)

-continued
(47)
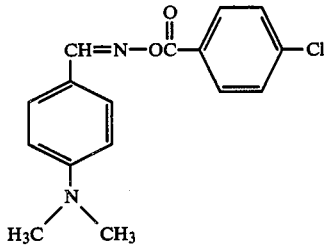
(48)
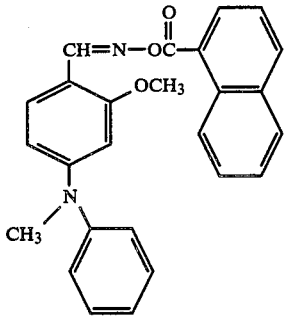
(49)
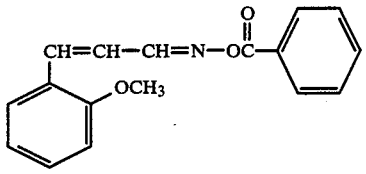
(50)
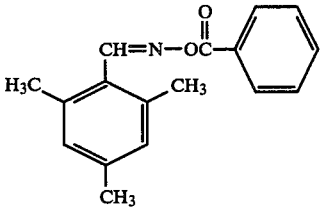
(51)
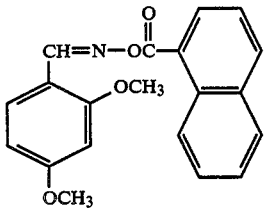
(52)
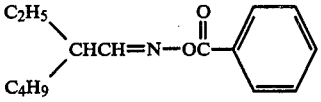
(53)
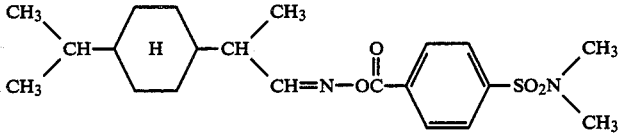
(54)
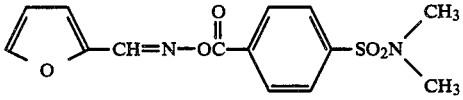
(55)
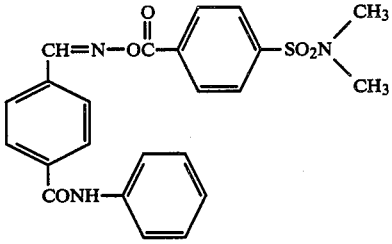
(56)
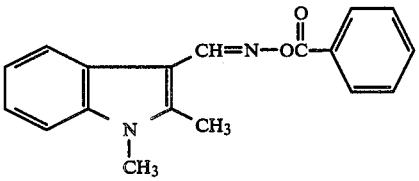
(57)
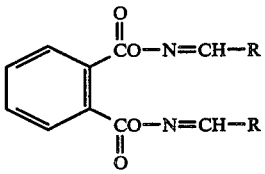
wherein:
R— is 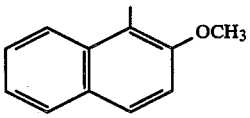

-continued (58)

Compound of (57) wherein: R— is

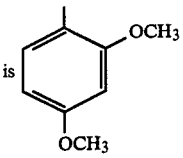

(59)

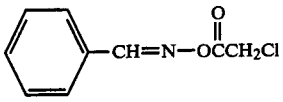

(60)

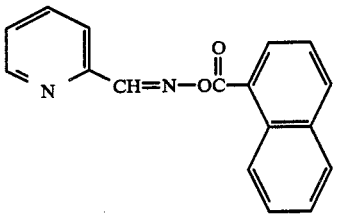

(61)

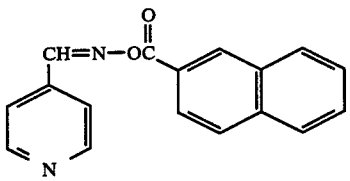

Methods of synthesizing the acid precursor according to the present invention are described below.

The acid precursor according to the present invention can be synthesized by reacting an aldoxime derivative (D) with an acid halide ($R^2COX$) or an acid anhydride $(R^2CO)_2O$ in the presence of a base, i.e.,

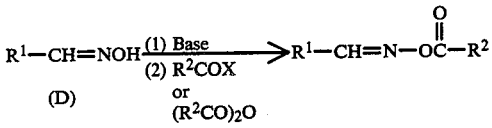

wherein X represents a halogen atom.

Bases that can be used for this reaction include organic bases such as pyridine, dimethylaminopyridine and triethylamine, etc., metal hydrides such as sodium hydride, etc., and metal alcoholates such as sodium methylate, etc. The simplest procedure which gives a high yield is to prepare a a sodium salt of (D) using sodium hydride, and to react it with an acid chloride at a low temperature. Specific synthesis examples of the acid precursor are shown below.

SYNTHESIS EXAMPLE 1

Synthesis of Acid Precursor (1):

With stirring, 8 g (0.167 mole) of 50% oily sodium hydride was added to 400 ml of an acetonitrile solution of 20 g (0.167 mole) of benzaldoxime. After the evolution of hydrogen gas ceased, the solution was cooled to 10° C., and while maintaining this temperature, 23.9 g (0.167 mole) of benzoyl chloride was added dropwise. The mixture was stirred at room temperature for 1 hour. The reaction mixture was added to 1 liter of water. The precipitated crystals were collected by filtration. The crude crystals were recrystallized from a solvent mixture of n-hexane and ethyl acetate (3/1 by volume) to obtain 27.3 g (0.12 mole) of Acid Precursor (1) having a melting point of 100.5° C. to 101° C.

SYNTHESIS EXAMPLE 2

Synthesis of Acid Precursor (8) (using sodium hydride)

Synthesis of 2-methoxy-1-naphthaldehyde 500 ml of a dimethylformamide solution containing 103.2 g (0.6 mole) of 2-hydroxy-1-naphthaldehyde and 107.6 g (0.78 mole) of anhydrous potassium carbonate was stirred with heating at 50° C. To the solution was added dropwise 145 g (0.78 mole) of methyl p-toluenesulfonate. After the completion of the dropwise addition, the mixture was stirred at 60° C. for 2 hours. The reaction mixture was added to 1.5 liters of water, and the precipitated crystals were collected by filtration. The crude crystals were recrystallized from a solvent mixture of n-hexane and ethyl acetate (5/1 by volume) to obtain 93.8 g (0.504 mole) of 2-methoxy-1-naphthaldehyde.

Synthesis of 2-methoxy-1-naphthaldoxime

To 400 ml of ethanol and 180 ml of water were added 80 g (0.43 mole) of 2-methoxy-1-naphthaldehyde, 66 g (0.81 mole) of sodium acetate and 35.5 g (0.51 mole) of hydroxylamine hydrochloride, and the mixture was refluxed by heating for 2 hours. After the reaction, the reaction mixture was added to 1 liter of water. The precipitated crystals were collected by filtration to obtain 85 g (0.42 mole) of 2-methoxy-1-naphthaldoxime.

Synthesis of Acid Precursor (8)

A sodium salt of aldoxime was prepared in the same manner as described in Synthesis Example 1 from 70.3 g (0.35 mole) of 2-methoxy-1-naphthaldoxime, 14 g (0.35 mole) of 60% oily sodium hydride and 750 ml of acetonitrile. The acetonitrile solution was cooled to 10° C., and while maintaining this temperature, 52 g (0.37 mole) of benzoyl chloride was added dropwise. After the completion of the dropwise addition, the mixture was stirred at room temperature for 1 hour. The reaction mixture was added to 2.5 liters of water, and the precipitated crystals were collected by filtration. The crude crystals were recrystallized from ethyl acetate to obtain 88 g (0.29 mole) of Acid Precursor (8) having a melting point of 127° C. to 128° C.

SYNTHESIS EXAMPLE 3

Synthesis of Acid Precursor (8) (using sodium methylate)

96.4 g (0.5 mole) of a 28% methanol solution of sodium methylate was added to 300 ml of a methanol solution of 101.5 g (0.5 mole) of 2-methoxy-1-naphthaldoxime, and the uniform solution obtained was concentrated under reduced pressure to about 200 ml. 1 liter of toluene was added to the concentrate, and the solution was stirred while cooling with ice. The precipitated crystals were collected by filtration, and washed with toluene to obtain 112 g of a sodium salt of oxime.

1.1 liters of an acetonitrile solution of the resulting sodium salt of oxime was stirred with cooling at 0° C. to 5° C., and while maintaining this temperature, 70 g (0.5 mole) of benzoyl chloride was added dropwise. After the completion of the dropwise addition, the mixture was stirred at room temperature for 1 hour. The reaction mixture was poured into ice water, and the precipitated crystals were collected by filtration. The crude crystals were recrystallized from ethyl acetate to obtain 99.6 g (0.33 mole) of Acid Precursor (8) having a melting point of 127° C. to 128° C.

SYNTHESIS EXAMPLE 4

Synthesis of Acid Precursor (29)

To 200 ml of an acetonitrile solution of 20.1 g (0.1 mole) of 2-methoxy-1-naphthaldoxime were added 4.8 g (0.1 mole) of 50% oily sodium hydride and then 18 g (0.1 mole) of p-chlorobenzoyl chloride in the same manner as described in Synthesis Example 1. After the completion of the addition, the reaction mixture was added to water. The resulting crude crystals were collected and recrystallized from a solvent mixture of n-hexane and ethyl acetate (1/1 by volume) to obtain 20.9 g (0.062 mole) of Acid Precursor (29) having a melting point of 128.5° C. to 130° C.

SYNTHESIS EXAMPLE 5

Synthesis of Acid Precursor (21)

To 300 ml of an acetonitrile solution of 32.2 g (0.16 mole) of 2-methoxy-1-naphthaldoxime were added 7.7 g (0.16 mole) of 50% oily sodium hydride and then 16.2 g (0.08 mole) of terephthaloyl chloride in the same manner as described in Synthesis Example 1. After the completion of the addition, the reaction mixture was added to water. The resulting crude crystals were collected and recrystallized from a solvent mixture of dimethylformamide and ethyl acetate (5/1 by volume) to obtain 18 g (0.034 mole) of Acid Precursor (21) having a melting point of 152° C. to 153° C.

SYNTHESIS EXAMPLE 6

Synthesis of Acid Precursor (42) (using sodium methylate):

Synthesis of 2-benzyloxy-1-naphthaldehyde 450 ml of a dimethylformamide solution containing 100 g (0.58 mole) of 2-hydroxy-1-naphthaldehyde and 96.3 g (0.7 mole) of anhydrous potassium carbonate was stirred with heating at 60° C. To the solution was added dropwise 88.3 g (0.7 mole) of benzyl chloride. After the completion of the dropwise addition, the mixture was stirred at 60° C. for 2 hours. Then 870 ml of ethyl acetate heated at 60° C. and 1.2 liters of warm water at 60° C. were added to the mixture and it was extracted at 60° C. and separated. The organic layer was concentrated under reduced pressure to about 550 ml. 440 ml of methanol was added to the concentrate, and the solution was cooled to 5° C. to crystallize. The precipitated crystals were collected by filtration, and washed with methanol to obtain 131 g (0.5 mole) of 2-benzyloxy-1-naphthaldehyde.

Synthesis of 2-benzoyloxy-1-naphthaldoxime

To 460 ml of methanol and 150 ml of water were added 120 g (0.46 mole) of 2-benzyloxy-1-naphthaldehyde, 75 g (0.92 mole) of sodium acetate and 48 g (0.69 mole) of hydroxylamine hydrochloride, and the mixture was refluxed by heating for 2 hours. After the reaction, the reaction mixture was added to 1.5 liters of water. The precipitated crystals were collected by filtration to obtain 125 g (0.45 mole) of 2-benzyloxy-1-naphthaldoxime.

Synthesis of Acid Precursor (42)

1 liter of an acetonitrile solution of 120 g (0.43 mole) of 2-benzyloxy-1-naphthaldoxime was cooled at 5° to 10° C. with stirring, and while maintaining this temperature, were added dropwise thereto about one quarter of 83.5 g (0.43 mole) of a 28% methanol solution of sodium methylate and then about one quarter of 109.4 g (0.78 mole) of benzoyl chloride. The above-described procedure was repeated four times to add the whole amount of the compounds, and the reaction mixture was stirred at 10° C. for 1 hour. After the reaction, the reaction mixture was cooled to 0° C. The precipitated crystals were collected by filtration, and washed with acetonitrile and then warm water (at about 35° C.) to obtain 147 g of the crude crystals of Acid Precursor (42).

The crude crystals thus-obtained were dissolved in a solvent mixture of 440 ml of ethyl acetate and 440 ml of dimethylformamide at 50° C., and the insoluble substance was removed with celite. The solution was added 880 ml of acetonitrile, and the solution was cooled to 5° C. to crystallize. The precipitated crystals were collected by filtration, and washed with acetonitrile to obtain 118 g (0.31 mole) of Acid Precursor (42) having a melting point of 130.5° C. to 131° C.

SYNTHESIS EXAMPLE 7

Synthesis of Acid Precursor (42) (without using a base):

To 800 ml of an acetonitrile solution of 111 g (0.4 mole) of 2-benzyloxy-1-naphthaldoxime, was added dropwise 68 g (0.48 mole) of benzoyl chloride, and the reaction mixture was stirred at 30° C. for 2 hours. After the reaction, the reaction mixture was cooled to 0° C. The precipitated crystals were collected by filtration and washed with acetonitrile to obtain 117 g of the crude crystals of Acid Precursor (42).

The crude crystals thus-obtained were purified in the same manner as described in Synthesis Example 6 to obtain 97 g (0.25 mole) of Acid Precursor (42) having a melting point of 130° C. to 131° C.

SYNTHESIS EXAMPLE 8

Synthesis of Acid Precursor (45)

600 ml of a dichloroethane solution containing 150 g (0.87 mole) of 2-hydroxy-1-naphthaldehyde and 250 g (1.87 moles) of anhydrous aluminum chloride was stirred with heating at 50° C. To the solution was added dropwise 172.2 g (1 mole) of N,N-diethylsulfamoyl chloride. After the completion of the dropwise addition, the mixture was refluxed for 3 hours. After cooling to room temperature, the reaction mixture was poured into 1 liter of ice water. Methylene chloride was added to the mixture and it was extracted and separated. The organic layer was concentrated to about 500 ml. To the concentrate was added methanol to precipitate crystals. The precipitated crystals were collected by filtration, and washed with methanol to obtain 228 g (0.74 mole) of 2-hydroxy-6-(N,N-diethylsulfamoyl)-1-naphthaldehyde.

The 2-hydroxy-6-(N,N-diethylsulfamoyl)-1-naphthaldehyde thus-obtained was methylated and then reacted using hydroxylamine hydrochloride and sodium acetate in the same manner as described in Synthesis Example 2 to obtain 2-methoxy-6-(N,N-diethylsulfamoyl)-1-naphthaldoxime.

To 300 ml of an acetonitrile solution of 20.5 g (0.085 mole) of 2-methoxy-6-(N,N-diethylsulfamoyl)-1-naphthaldoxime were added 3.4 g (0.085 mole) of 60% oily sodium hydride and then 12 g (0.085 mole) of benzoyl chloride in the same manner as described in Synthesis Example 1. After the completion of the addition, the reaction mixture was added to water. The resulting crude crystals were collected and recrystallized from ethyl acetate to obtain 30.3 g (0.069 mole) of Acid Precursor (45) having a melting point of 140.5° C. to 141° C.

The acid precursor according to the present invention can generate an acid efficiently while it is present in a substantially dry film. Accordingly, the acid precursor according to the present invention is advantageously used to induce a chemical change by the acid generated upon heating.

The amount of the acid precursor used in the present invention varies depending upon the specific precursor and the system in which it is used, but is generally not more than 50% by weight, preferably not more than 30% by weight, based on the total weight of the coated layer. The acid precursors according to the present invention can be used either singly or in combination with each other or with acid precursors other than those of the present invention.

The acid precursor according to the present invention can be incorporated into a binder by dissolving it in a water-soluble organic solvent (such as methanol, ethanol, acetone or dimethylformamide, etc.) or a mixture of the organic solvent and water.

The acid precursor according to the present invention can also be incorporated in the form of fine particles into a binder.

Preferred acid precursors according to the present invention are these which decompose not more than 80%, preferably not more than 50%, and more preferably not more than 20%, based on the whole amount thereof added until the appropriate time of development (at the time just before fog increases). The % decomposition of the acid precursor can be determined by preparing a calibration curve on the relationship between the pH value and the acid amount in the light-sensitive material using the acid which is generated by decomposition of the acid precursor, and measuring the pH value of layers to determine the acid amount generated from the calibration curve.

In the present invention, the dye providing compound which has a dye moiety in its molecule and which forms a dye having a different diffusibility from that of the dye providing compound, in correspondence or countercorrespondence to the reaction wherein the light-sensitive silver halide is reduced to silver under high temperature conditions is preferably represented by formula (C I).

$$(\text{Dye}-X)_q-Y \qquad \text{(C I)}$$

wherein Dye represents a dye which becomes mobile when it is released from the molecule of the compound represented by the general formula (C I); X represents a simple bond or a connecting group; Y represents a group which releases Dye in correspondence or countercorrespondence to light-sensitive silver salts having a latent image distributed imagewise, the diffusibility of Dye released being different from that of the compound represented by formula (C I) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Patent Application No. 76,492 can be utilized.

Examples of the connecting group represented by X include —NR— (wherein R represents a hydrogen atom, an alkyl group, or a substituted alkyl group), $-SO_2-$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (C I) are described in greater detail.

In one embodiment, Y is selected so that the compound represented by the general formula (C I) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (C II) is illustrated for Y.

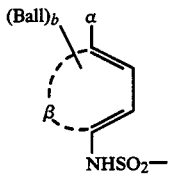

(CII)

wherein $\beta$ represents a non-metallic atomic group necessary for forming a benzene ring, which may be condensed with a carbon ring or a hetero ring, forming, for example, a naphthalene ring, a quinoline ring, a 5,6,7,8-tetrahydronaphthalene ring, or a chroman ring, etc.; $\alpha$ represents $-OG^{11}$ or $-NHG^{12}$, wherein $G^{11}$ represents a hydrogen atom or a group forming a hydroxyl group upon hydrolysis, and $G^{12}$ represents a hydrogen atom, an alkyl group having from 1 to 22 carbon atoms, or a hydrolyzable group; Ball represents a ballast group; and b represents an integer of 0, 1 or 2.

Specific examples of Y of the type illustrated by formula (C II) are described in Japanese Patent Application (OPI) Nos. 33826/73 and 50736/78.

Another example of Y which is effective for compounds of this type is a group represented by formula (C III)

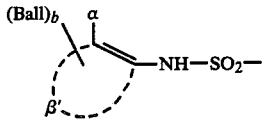

(CIII)

wherein

Ball, $\alpha$, and b each has the same meaning as defined for formula (C II); and $\beta'$ represents an atomic group forming a carbon ring, including a benzene ring. The benzene ring may be condensed with a carbon ring or a hetero ring, thereby forming, for example, a naphthalene ring, a quinoline ring, a 5,6,7,8-tetrahydronaphthalene ring, or a chroman ring.

Specific examples of Y of the type illustrated by the general formula (C III) are described in Japanese Patent Application (OPI) Nos. 113624/76, 12642/81, 16130/81, 16131/81, 4043/82, and 650/82, and U.S. Pat. No. 4,053,312.

A further example of Y which is effective for compounds of this type is a group represented by formula (C IV)

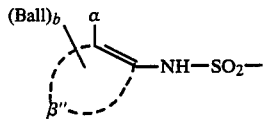

(CIV)

wherein Ball, α, and b each has the same meaning as defined for formula (C II); and β'' represents an atomic group forming a heterocyclic ring such as a pyrazole ring or a pyridine ring, which may be condensed with a carbocyclic ring or a heterocyclic ring.

Specific examples of Y of the type illustrated by formula (C IV) are described in Japanese Patent Application (OPI) No. 104343/76.

A still further example of Y which is effective for compounds of this type is a group represented by formula (C V)

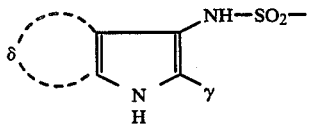

(CV)

wherein γ represents preferably a hydrogen atom, a substituted or unsubstituted alkyl group, a substituted or unsubstituted aryl group, a substituted or unsubstituted heterocyclic group, or —CO—$G^{21}$, wherein $G^{21}$ represents —$OG^{22}$, —S—$G^{22}$, or

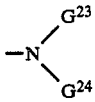

wherein $G^{22}$ represents a hydrogen atom, an alkyl group, a cycloalkyl group or an aryl group, $G^{23}$ has the same as defined for $G^{22}$ or represents an acyl group derived from an aliphatic or aromatic carboxylic acid or sulfonic acid, and $G^{24}$ represents a hydrogen atom or a substituted or unsubstituted alkyl group; and δ represents an atomic group completing a condensed benzene ring.

Specific examples of Y of the type illustrated by formula (C V) are described in Japanese Patent Application (OPI) Nos. 104343/76, 46730/78, 130122/79 and 85055/82.

A still further example of Y which is effective for compounds of this type is a group represented by formula (C VI)

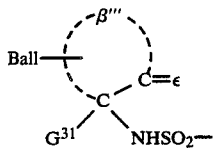

(CVI)

wherein Ball has the same meaning as defined for formula (C II); and ε represents an oxygen atom or =$NG^{32}$ wherein $G^{32}$ represents a hydroxyl group or an unsubstituted or substituted amino group. The compounds of formula $H_2N$—$G^{32}$ include hydroxyamine, hydrazines, semicarbazides, and thiosemicarbazides, etc. β''' represents a 5-membered, 6-membered or 7-membered saturated or unsaturated non-aromatic hydrocarbon ring. $G^{31}$ represents a hydrogen atom or a halogen atom, for example, a fluorine atom, a chlorine atom, or a bromine atom.

Specific examples of Y illustrated by formula (C VI) are described in Japanese Patent Application (OPI) Nos. 3819/78 and 48534/79.

Other examples of Y for the compound of this type are described in, for example, Japanese Patent Publication Nos. 32129/73 and 39165/73, Japanese Patent Application (OPI) No. 64436/74, and U.S. Pat. No. 3,443,934, etc.

A still further example of Y which is effective for compounds of this type is a group represented by formula

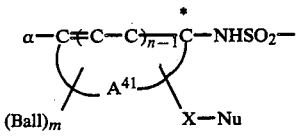

(CVII)

wherein α represents $OR^{41}$ or $NHR^{42}$, wherein $R^{41}$ represents a hydrogen atom or a hydrolyzable group, and $R^{42}$ represents a hydrogen atom or an alkyl group having from 1 to 50 carbon atoms; $A^{41}$ represents an atomic group necessary for forming an aromatic ring; Ball represents an organic immobilizing group present in the aromatic ring; m represents an integer of 1 or 2, and when m represents 2, Ball's may be the same or different; X represents a divalent organic group having from 1 to 8 atoms which forms a 5- to 12-membered ring in combination with an electrophilic center carbon atom, indicated by *, by oxidation with a nucleophilic group (Nu); Nu represents a nucleophilic group; and n represents an integer of 1 or 2. α may have the same meaning as defined for (C II).

Specific examples of Y illustrated by the general formula (C VII) are described in Japanese Patent Application (OPI) No. 20735/82.

Another type of compound represented by formula (C I) is a nondiffusible image forming compound which undergoes self-ring closing in the presence of a base, thereby releasing a diffusible dye, but does not substantially cause dye release by reacting with an oxidized product of a developing agent.

An example of Y which is effective for compounds of this type is a group represented by formula (C VIII)

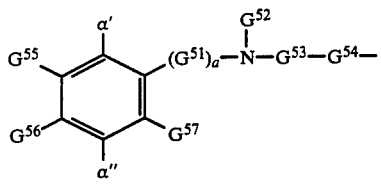

(CVIII)

wherein $\alpha'$ represents an oxidizable nucleophilic group, such as a hydroxyl group, a primary or secondary amino group, a hydroxyamino group, or a sulfonamido group, or a precursor thereof; $\alpha''$ represents a dialkylamino group or any one of the groups defined for $\alpha'$; $G^{51}$ represents an alkylene group having 1 to 3 carbon atoms; a represents an integer of 0 or 1; $G^{52}$ represents a substituted or unsubstituted alkyl group having 1 to 40 carbon atoms or a substituted or unsubstituted aryl group having 6 to 40 carbon atoms; $G^{53}$ represents an electrophilic group, such as —CO— or —CS—, etc.; $G^{54}$ represents an oxygen atom, a sulfur atom, a selenium atom, or a nitrogen atom. When it is a nitrogen atom, it may be substituted with a hydrogen atom, an alkyl or substituted alkyl group having from 1 to 10 carbon atoms, or an aromatic residue having from 6 to 20 carbon atoms; $G^{55}$, $G^{56}$ and $G^{57}$ each represents a hydrogen atom, a halogen atom, a carbonyl group, a sulfamoyl group, a sulfoanmido group, an alkyloxy group having 1 to 40 carbon atoms or the same group as defined for $G^{52}$, or $G^{55}$ and $G^{56}$, when taken together, may form a 5- to 7-membered ring; or $G^{56}$ may be a group of the formula

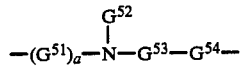

wherein $G^{51}$, a, $G^{52}$, $G^{53}$ and $G^{54}$ are as defined above, and at least one of $G^{52}$, $G^{55}$, $G^{56}$ and $G^{57}$ represents a ballast group. Examples of Y of this type is disclosed in Japanese Patent Application (OPI) No. 63618/76.

Other examples of Y which are effective for compounds of this type are groups represented by formulae (C IX) and (C X)

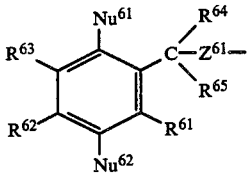

(CIX)

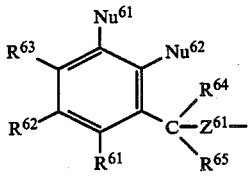

(CX)

wherein $Nu^{61}$ and $Nu^{62}$ (which may be the same or different) each represents a nucleophilic group or a precursor thereof; $Z^{61}$ represents a divalent atomic group which is electrically negative with respect to the carbon atom at which $R^{64}$ and $R^{65}$ are substituted; $R^{61}$, $R^{62}$, and $R^{63}$, which may be the same or different, each represents a hydrogen atom, a halogen atom, an alkyl group, an alkoxyl group, or an acylamino group, $R^{61}$ and $R^{62}$, when adjacent on the ring, may form a condensed ring, and $R^{62}$ and $R^{63}$, when adjacent on the ring, may form a condensed ring; $R^{64}$ and $R^{65}$, which may be the same or different each represents a hydrogen atom, a hydrocarbon group, or a substituted hydrocarbon group; and a sufficiently large ballast group, Ball, to make the compound immobile is present in at least one of $R^{61}$, $R^{62}$, $R^{63}$, $R^{64}$, and $R^{65}$.

Specific examples of Y illustrated by formulae (C IX) and (C X) are described in Japanese Patent Application (OPI) Nos. 69033/78 and 130927/79.

A further example of Y for compounds of this type is a group represented by formula (C XI)

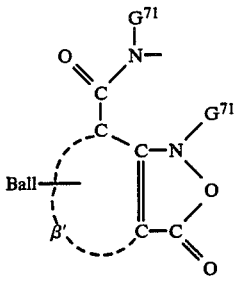

(C XI)

wherein Ball and $\beta'$ each has the same meaning as defined for formula (C III); and $G^{71}$ represents an alkyl group (including a substituted alkyl group).

Specific examples of Y illustrated by formula (C XI) are described in Japanese Patent Application (OPI) Nos. 111628/74 and 4819/77.

A still another type of compound represented by formula (C I) is a nondiffusible image forming compound which does not release a dye by itself, but releases a dye on reacting with a reducing agent. In this case, it is preferred to use in combination an "electron donor" compound facilitating the redox reaction.

An example of Y which is effective for compounds of this type is a group represented by formula (C XII)

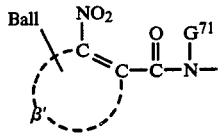

(C XII)

wherein Ball and $\beta'$ each has the same meaning as defined for formula (C III); and $G^{71}$ represents an alkyl group (including a substituted alkyl group).

Specific examples of Y illustrated by formula (C XII) are described in Japanese Patent Application (OPI) Nos. 35533/78 and 110827/78.

Another example of Y which is effective for compounds of this type is a group represented by formula (C XIII)

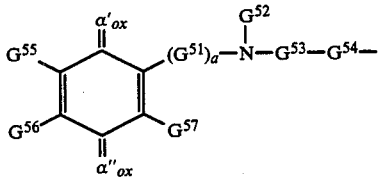

(C XIII)

wherein $\alpha'_{ox}$ and $\alpha''_{ox}$ each represents a group releasing $\alpha'$ or $\alpha''$ upon reduction and $\alpha'$, $\alpha''$, $G^{51}$, $G^{52}$, $G^{53}$, $G^{54}$, $G^{55}$, $G^{56}$, $G^{57}$, and a each has the same meaning as defined formula (C VIII).

Specific examples of Y illustrated by formula (C XIII) are described in Japanese Patent Application (OPI) No. 110827/78, and U.S. Pat. Nos. 4,356,249 and 4,358,525.

Further examples of Y which are effective for compounds of this type are groups represented by formulae (C XIVA) and (C XIVB):

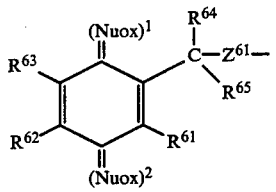

(C XIVA)

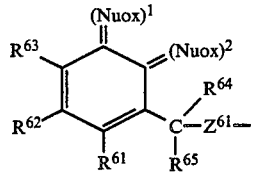

(C XIVB)

wherein $(Nuox)^1$ and $(Nuox)^2$, which may be the same or different, each represents an oxidized nucleophilic group; and $R^{61}$, $R^{62}$, $R^{63}$, $R^{64}$, $R^{65}$, and $Z^{61}$ each has the same meaning as defined for formulae (C IX) and (C X).

Specific examples of Y illustrated by formulae (C XIVA) and (C XIVB) are described in Japanese Patent Application (OPI) Nos. 130927/79 and 16342/81.

In the references cited in connection with formulae (C XII), (C XIII), (C XIVA), and (C XIVB), such are described electron donors to be used in combination with these compounds.

A still another type of compound represented by formula (C I) is a linked donor acceptor compound (an LDA compound). This compound is a nondiffusible image forming compound which releases a diffusible dye by a donor acceptor reaction in the presence of a base, but does not substantially cause dye formation by reacting with an oxidized product of a developing agent.

An example of Y which is effective for compounds of this type is a group represented by formula (C XV)

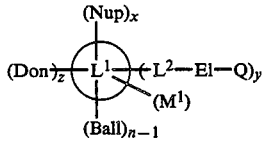

(C XV)

wherein n, x, y and z each represents 1 or 2; m represents an integer of 1 or more; Don represents a group containing an electron donor or a precursor moiety thereof; $L^1$ represents an organic group connecting Nup to —El—Q or Don; Nup precursor of a nucleophilic group; El represents an electrophilic center; Q represents a divalent group; Ball represents a ballast group; $L^2$ represents a connecting group; and M' represents an appropriate substituent.

Specific examples of Y illustrated by formula (C XV) are described in Japanese Patent Application No. 60289/83.

The ballast group is an organic ballast group capable of making dye image forming compounds nondiffusible, and is preferably a group containing a hydrophobic group having from 8 to 32 carbon atoms. These organic ballast groups are linked to the dye image forming compounds, directly or through a connecting group, such as an imino bond, an ether bond, a thioether bond, a carbonamido bond, a sulfonamido bond, a ureido bond, an ester bond, an imido bond, a carbamoyl bond, and a sulfamoyl bond. These connecting groups may be used singly or in combination with each other. Two or more kinds of the dye-providing substances can be employed together. In such a case two or more kinds of dye-providing substances may be used together in order to represent the same hue or in order to reproduce black color.

The dye providing substances are preferably employed in a range from 10 mg/m$^2$ to 15 g/m$^2$, and more preferably in a range from 20 mg/m$^2$ to 10 g/m$^2$ (in total).

The description "in correspondence or countercorrespondence to light-sensitive silver salts having a latent image" used herein with respect to the present invention is explained as follows.

When a negative type silver halide emulsion is used in conjunction with Compound (1) having Y represented by formula (C III), silver halide is reduced in a latent image pattern and Compound (1) is oxidized in the same pattern, releasing a dye; that is, the dye is released corresponding to the light-sensitive silver salt having the latent image. Since the dye released does not contain a ballast group, a difference in diffusibility exists between Compound (1) and the dye, as a result of which only the dye thus released migrates to a dye-fixing layer, forming a color image in correspondence to the latent image.

In contrast, when a positive type silver halide emulsion is used in place of the negative type silver halide emulsion, the dye is released in countercorrespondence to the latent image. Moreover, when a compound having Y represented by formula (C VIII) is used and a developing agent is used separately, the dye is released in countercorrespondence to the latent image even if negative type silver halide emulsions are used.

As described above, depending on the type of the emulsion or image forming compound used, a dye image is formed either in correspondence or in countercorrespondence to the latent image formed in the light-sensitive silver salt.

The dye providing substance used in the present invention can be introduced into a layer of the light-sensitive material by known methods such as a method as described in U.S. Pat. No. 2,322,027. In this case, an organic solvent having a high boiling point or an organic solvent having a high boiling point or an organic solvent having a low boiling point as described below can be used. For example, the dye providing substance is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), a fatty acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Application (OPI) No. 59943/76. Moreover, various surface active agents can be used when the dye providing substance is dispersed in a hydrophilic colloid. For this purpose, the surface active agents illustrated in other parts of the specification can be used.

An amount of the organic solvent having a high boiling point used in the present invention is 10 g per g of the dye providing substance used or less, preferably 5 g per g or less.

In the present invention, it is desirable that a reducing substance be incorporated into the light-sensitive material. Preferred examples of the reducing substances include known reducing agents and the reducing dye providing substances as described above.

The reducing agents used in the present invention include the following compounds:

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Examples of more preferred reducing agents include 3-pyrazolidone compounds such as, for example, 1-phenyl-3-pyrazolidone, 1-phenyl-4,4-dimethyl-3-pyrazolidone, 4-hydroxymethyl-4-methyl-1-phenyl-3-pyrazolidine, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, and 5-methyl-3-pyrazolidone.

Various combinations of developing agents as described in U.S. Pat. No. 3,039,869 can also be used.

In the present invention, an amount of reducing agent added is from 0.01 mol to 20 mols per mol of silver, and more preferably from 0.1 mol to 10 mols per mol of silver.

In the present invention, various dye releasing assistants can be used. As the dye releasing assistants, bases or base precursors which are compounds showing a basic property and a capability for accelerating development or compounds having the so-called nucleophilic property.

The dye releasing assistants can be used in any of the light-sensitive materials and dye fixing materials. In the case of incorporating them in light-sensitive materials, it is particularly advantageous to use base precursors. The term "base precursor" means a substance which releases a base component by heating, wherein the base component released may be any inorganic base of organic base.

Examples of preferred bases include, as inorganic bases, hydroxides, secondary or tertiary phosphates, borates, carbonates, quinolinic acid salts, and metaborates of alkali metals or alkaline earth metals; ammonium hydroxide; quaternary alkylammonium hydroxide; and other metal hydroxides; and, as organic bases, aliphatic amines (trialkylamines, hydroxylamines and aliphatic polyamines), aromatic amines (N-alkyl substituted aromatic amines, N-hydroxyalkyl substituted aromatic amines and bis[p-(dialkylamino)phenyl]methanes), heterocyclic amines, amidines, cyclic amidines, quanidines, cyclic quanidines, etc. Further, betaine tetramethylammonium iodide and diaminobutane dihydrochloride as described in U.S. Pat. No. 2,410,644 and urea and organic compounds including amino acids such as 6-aminocaproic acid as described in U.S. Pat. No. 3,506,444 are useful. In the present invention, compounds having a pKa value of 8 or more are particularly useful.

As the base precursors, substances which undergo reaction by heating to release a base, such as salts of an organic acid which is decarboxylated by heating to cause decomposition and a base, or compounds which are decomposed by Lossen rearrangement or Backman rearrangement to release an amine, are used.

As preferred base precursors, there are precursors of the above described organic bases. For example, there are salts of thermally decomposable organic acid such as trichloroacetic acid, trifluoroacetic acid, propiolic acid, cyanoacetic acid, sulfonylacetic acid or acetoacetic acid, etc., and salts of 2-carboxycarboxamide as described in U.S. Pat. No. 4,088,496, etc.

Preferred examples of the base precursors are described below.

For example, compounds which are believed to release a base by decarboxylation of the acid moiety can be used. For instance, trichloroacetic acid derivatives that can be used include quanidine trichloroacetic acid, piperidine trichloroacetic acid, morpholine trichloroacetic acid, p-toluidine trichloroacetic acid, and 2-picoline trichloroacetic acid, etc.

In addition, base precursors as described in British Pat. No. 998,945, U.S. Pat. No. 3,220,846, Japanese Patent Application (OPI) No. 22625/75, etc., can be used.

As substances besides trichloroacetic acids, other useful substances include 2-carboxycarboxamide derivatives as described in U.S. Pat. No. 4,088,496, α-sulfonylacetate derivatives as described in U.S. Pat. No. 4,060,420, salts of propiolic acid derivatives and bases as described in Japanese Patent Application No. 55700/83, etc. Salts using alkali metal and alkaline earth metal as a base component besides organic bases are also effective and described in Japanese Patent Application No. 69597/83.

As other precursors, hydroxamic carbamates as described in Japanese Patent Application No. 43860/83 utilizing Lossen rearrangement and aldoxime carbamates as described in Japanese Patent Application No. 31614/83 which form nitrile, etc., are effective.

Further, amineimides as described in *Research Disclosure,* No. 15776 (May, 1977) and aldonic amides as described in Japanese Patent Application (OPI) No. 22625/75 are suitably used, because they form a base by decomposition at a high temperature.

These bases and base precursors can be used over a wide range. An effective range is not more than 50% by weight based on the weight of the dried coating film in the light-sensitive material, and preferably the range is from 0.01% by weight to 40% by weight.

It is of course possible to use the above described bases or base precursors not only for dye release acceleration, but also for other purposes, for example, control of the pH value.

In the present invention, it is preferred to use the above described base precursors since the effects of the present invention are particularly exhibited. In this case, the weight ratio of the base precursor/the acid precursor according to the present invention is preferably from 1/20 to 20/1, and more preferably from 1/5 to 5/1.

The binder which can be used in the present invention can be employed individually or in a combination thereof. A hydrophilic binder can be used as the binder according to the present invention. The typical hydrophilic binder is a transparent or translucent hydrophilic colloid, examples of which include natural substances, for example, a protein such as gelatin, a gelatin derivative, a cellulose derivative, etc., a polysaccharide such as starch, gum arabic, etc., and synthetic polymeric substances, for example, a water-soluble polyvinyl compound such as polyvinyl pyrrolidone, acrylamide polymer, etc. Another example of the synthetic polymeric substance is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium.trichloroacetate as described in U.S. Pat. No. 3,301,678, bisisothiuroniums including 1,8-(3,6-dioxaoctane)-bis(isothiuronium.trichloroacetate), etc., as described in U.S. Pat. No. 3,669,670, thiol compounds as described in West German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid moiety such as bis(2-amino-2-thiazolium)methylene-bis(sulfonylacetate), 2-amino-2-thiazolium phenylsulfonylacetate, etc., as described in U.S. Pat. No. 4,060,420, and compounds having 2-carboxycarboxamide as an acid moiety as described in U.S. Pat. No. 4,088,496.

In addition, azole thioether and blocked azoline thione compounds as described in Belgian Pat. No. 768,071, 4-aryl-1-carbamoyl-2-tetrazoline-5-thione compounds as described in U.S. Pat. No. 3,893,859 and compounds as described in U.S. Pat. Nos. 3,839,041, 3,844,788 and 3,877,940 are suitably used.

In the present invention, image toning agents can be incorporated, if desired. Effective toning agents are compounds such as 1,2,4-triazole, 1H-tetrazole, thiouracil and 1,3,4-thiadiazole, etc. Examples of preferred toning agents include 5-amino-1,3,4-thiadiazole-2-thiol, 3-mercapto-1,2,4-triazole, bis(dimethylcarbamoyl)disulfide, 6-methylthiouracil and 1-phenyl-2-tetrazoline-5-thione, etc. Particularly effective toning agents are compounds which can form black images.

The concentration of the toning agents incorporated varies according to the kind of heat-developable light-sensitive material, processing conditions, images desired to be formed, and other factors, but it is generally in a range of from about 0.001 to 0.1 mol per mol of silver in the light-sensitive material.

The above-described components composing the heat-developable light-sensitive materials of the present invention can be arranged in any appropriate positions. For example, one or more components can be arranged in one or more film layers in the light-sensitive material, if necessary. In some cases, it is desirable to incorporate the above described reducing agents, image stabilizers and/or other additives in the protective layer in specified amounts (rates). Such a case is sometimes advantageous, because movement of additives between layers in the heat-developable light-sensitive material can be reduced.

The heat-developable light-sensitive materials according to the present invention are effective for forming negative images or positive images. Formation of the negative images or positive images will depend mainly upon selection of the specified light-sensitive silver halide. For example, in order to form direct positive images, it is possible to use an internal latent image-forming silver halide emulsion as described in U.S. Pat. Nos. 2,592,250, 3,206,313, 3,367,778 and 3,447,927, or a mixture of a surface latent image-forming silver halide emulsion as described in U.S. Pat. No. 2,996,382 and an internal latent image-forming silver halide emulsion.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, are useful in these dyes, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used.

These sensitizing dyes can be employed individually, and can also be employed as combinations thereof. A combination of sensitizing dyes is often useful, particularly for the purpose of supersensitization.

The sensitizing dyes may be present in the emulsion together with dyes which themselves do not have spectral sensitizing effects, but which exhibit a supersensitizing effect, or materials which do not substantially absorb visible light, but which exhibit a supersensitizing effect. For example, aminostilbene compounds substituted with a nitrogen-containing heterocyclic group (e.g., those as described in U.S. Pat. Nos. 2,933,390 and 3,635,721), aromatic organic acid-formaldehyde condensates (e.g., those as described in U.S. Pat. No. 3,743,510), cadmium salts, azaindene compounds, etc., can be present. The combinations as described in U.S. Pat. Nos. 3,615,613, 3,615,641, 3,617,295 and 3,635,721 are particularly useful.

In the present invention, various means for exposure can be used. Latent images are obtained by imagewise exposure of radiant rays containing visible light. Generally, light sources conventionally used, for example, sun light, a strobo, a flash, a tungsten lamp, a mercury lamp, a halogen lamp such as an iodine lamp, etc., a xenon lamp, a laser, a CRT light source, a plasma light source, a fluorescent tube and a light emitting diode, etc., can be used as a light source.

In the present invention, development is carried out by applying heat to the light-sensitive materials. The heating means may be a hot plate, iron, heat roller, exothermic materials utilizing carbon or titanium white, etc., or analogues thereof.

A support used in the light-sensitive material and a dye fixing material which is used, if desired, in the present invention, is one which is not adversely affected by processing temperature. Useful supports include not only glass, paper, metal, and analogues thereof, but also acetyl cellulose films, cellulose ester films, polyvinyl acetal films, polystyrene films, polycarbonate films, polyethylene terephthalate films and films which are related to these films, and resin materials. Further, paper supports laminated with a polymer such as polyethylene, etc., can be used. Polyesters as described in U.S. Pat. Nos. 3,634,089 and 3,725,070 are also suitably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

In the case of using the dye providing substance which releases imagwise a mobile dye according to the present invention, the transfer of dye from the light-sensitive layer to the dye fixing layer can be carried out using a dye transfer assistant.

The dye transfer assistant suitably used in a process wherein it is supplied from the outside, include water and an alkaline aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

A more preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes, and other heterocyclic compounds.

With respect to other compounds capable of being used in the light-sensitive material in the present invention, for example, sulfamide derivatives, cationic compounds having a pyridinium group, etc., surfactants having a polyethylene oxide chain, antihalation and antiirradiation dyes, hardeners and mordanting agents, etc., it is possible to use those as described in European Pat. Nos. 76,492 and 66,282, West German Pat. No. 3,315,485, Japanese Patent Application Nos. 28928/83 and 26008/83, etc. Further, the exposure can be performed according to the methods as described in these patents.

The light-sensitive silver halides which can be used in the present invention are disclosed, for example, in European Pat. No. 76492.

The present invention will be explained in greater detail with reference to the following examples, but the present invention is not to be construed as being limited thereto.

EXAMPLE 1

A method for preparing a silver iodobromide emulsion is described below.

40 g of gelatin and 26 g of potassium bromide (KBr) were dissolved in 3,000 ml of water and the solution was maintained at 50° C. with stirring. A solution of 34 g of silver nitrate dissolved in 200 ml of water was added to the above-prepared solution over 10 minutes. Then, a solution of 3.3 g of potassium iodide (KI) dissolved in 100 ml of water was added over 2 minutes. The thus-prepared silver iodobromide emulsion was adjusted in pH, precipitated, and freed of excess salts. It was then adjusted to a pH of 6.0, whereby 400 g of a silver iodobromide emulsion was obtained.

A method for preparing a silver benzotriazole emulsion is described below.

28 g of gelatin and 13.2 g of benzotriazole were dissolved in 3,000 ml of water and the solution was maintained at 40° C. with stirring. A solution of 17 g of silver nitrate dissolved in 100 ml of water was added to the above-prepared solution over 2 minutes. The thus-prepared silver benzotriazole emulsion was adjusted in pH, precipitated, and freed of excess salts. It was then adjusted to a pH of 6.0, thereby 400 g of a silver benzotriazole emulsion was obtained.

A method for preparing a gelatin dispersion of a dye providing substance is described below.

A mixture of 5 g of Dye Providing Substance (1) shown below, 0.5 g of succinic acid 2-ethylhexyl ester sulfonic acid sodium salt, 5 g of tricresyl phosphate (TCP) and 30 ml of ethyl acetate was dissolved by heating at about 60° C. This solution was mixed with 100 g of a 10% aqueous solution of gelatin and the mixture was dispersed by means of a homogenizer at 10,000 rpm for 10 minutes. The dispersion thus obtained was designated a dispersion of dye providing substance.

Dye Providing Substance (1):

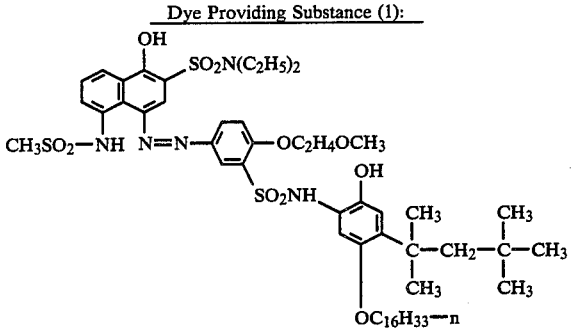

A method for preparing a gelatin dispersion of an acid precursor is described below.

10 g of Acid Precursor (8) according to the present invention was added to 100 g of a 1% aqueous solution of gelatin and the mixture was ground in a mill using 100 g of glass beads having an average diameter of about 0.6 mm for 10 minutes. By removing the glass beads by filtration, a gelatin dispersion of an acid precursor was obtained.

In the following, a method for preparing Light-Sensitive Materials A and B is described.

| Light-Sensitive Material A | |
|---|---|
| (a) Silver iodobromide emulsion | 20 g |
| (b) Silver benzotriazole emulsion | 10 g |
| (c) Dispersion of Dye Providing Substance (1) | 33 g |
| (d) 5% Aqueous solution of a compound having the following formula: | 10 ml |

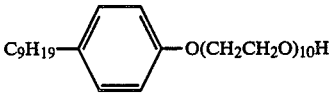

| | |
|---|---|
| (e) 10% Aqueous solution of a compound having the following formula: $H_2NSO_2N(CH_3)_2$ | 4 ml |
| (f) Solution containing 1.6 g of guanidine trichloroacetate (a base precursor) dissolved in 16 ml of ethanol | |
| (g) Gelatin dispersion of Acid Precursor (8) according to the present invention | 10 ml |

The above components (a) to (g) were mixed and dissolved by heating and the mixture was coated on a polyethylene terephthalate film having a thickness of 180 μm at a wet layer thickness of 33 μm, and then dried. On the thus-formed layer, a solution having the following composition was coated at a wet layer thickness of 30 μm and dried to form a protective layer, whereupon Light-Sensitive Material A was prepared.

| | |
|---|---|
| (a) 10% Aqueous solution of gelatin | 30 ml |
| (b) Water | 70 ml |
| Light-Sensitive Material B | |
| (a) Silver iodobromide emulsion | 20 g |
| (b) Silver benzotriazole emulsion | 10 g |
| (c) Dispersion of Dye Providing Substance (1) | 33 g |
| (d) 5% Aqueous solution of a compound having the following formula: | 10 ml |

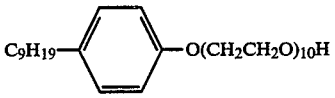

| | |
|---|---|
| (e) 10% Aqueous solution of a compound having the following formula: $H_2NSO_2N(CH_3)_2$ | 4 ml |
| (f) Solution containing 1.6 g of guanidine trichloroacetate (a base precursor) dissolved in 16 ml of ethanol | |
| (g) Water | 10 ml |

The above components (a) to (g) were mixed and dissolved by heating and the mixture was coated on a polyethylene terephthalate film having a thickness of 180 μm at a wet layer thickness of 33 μm, and dried. On the thus-formed layer, the protective layer was provided in the same manner as described for Light-Sensitive Material A.

A method for preparing an image receiving material having an image receiving layer is described below.

10 g of a methyl acrylate/N,N,N-trimethyl-N-vinylbenzylammonium chloride (1:1 by mol) copolymer was dissolved in 200 ml of water and then uniformly mixed with 100 g of a 10% aqueous solution of lime-processed gelatin. The resulting mixture was uniformly coated at a wet layer thickness of 90 μm on a paper support laminated with polyethylene with titanium dioxide dispersed therein. The thus-produced material was dried and then used as an image receiving material.

Light-Sensitive Materials A and B were each exposed imagewise for 10 seconds at 2,000 lux using a tungsten lamp and then uniformly heated for 30 seconds or 60 seconds on a heat block heated at 140° C.

The image receiving material was soaked in water and then superimposed on each of the above-heated Light-Sensitive Materials A and B in such a manner that their coated layers were in contact with each other.

After heating for 6 seconds on a heat block maintained at 80° C., the image receiving material was separated from the light-sensitive material, whereupon a negative magenta color image was obtained in the image receiving material.

The negative image was measured for its density by means of a Macbeth reflective densitometer (RD-519). The results thus-obtained are shown in Table 1.

TABLE 1

| Light-Sensitive Material | Heating at 140° C. for 30 Seconds | | Heating at 140° C. for 60 seconds | |
|---|---|---|---|---|
| | Maximum Density | Minimum Density | Maximum Density | Minimum Density |
| A (Present Invention) | 2.00 | 0.10 | 2.10 | 0.20 |

TABLE 1-continued

| Light-Sensitive Material | Heating at 140° C. for 30 Seconds | | Heating at 140° C. for 60 seconds | |
|---|---|---|---|---|
| | Maximum Density | Minimum Density | Maximum Density | Minimum Density |
| B (Comparison) | 2.15 | 0.15 | 2.35 | 0.85 |

It is apparent from the results shown in Table 1 that the increases in the maximum density and minimum density are small even when the developing time is doubled due to the use of the acid precursor according to the present invention. On the contrary, in the comparative sample, a remarkable increase of the fog was observed. Therefore, it is understood that the acid precursor according to the present invention has a significant effect on stopping development.

EXAMPLE 2

In this example, the cases wherein a silver benzotriazole emulsion is not used as illustrated.

A method for preparing Light-Sensitive Materials C and D is described below.

| Light-Sensitive Material C | |
|---|---|
| (a) Light-sensitive silver iodobromide emulsion (the same as described in Example 1) | 25 g |
| (b) Dispersion of Dye Releasing Substance (1) (the same as described in Example 1) | 33 g |
| (c) 5% Aqueous solution of a compound having the following formula: | 10 ml |

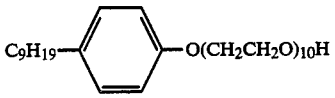

| | |
|---|---|
| (d) 10% Aqueous solution of a compound having the following formula: $N_2NSO_2N(CH_3)_2$ | 4 ml |
| (e) Solution containing 1.5 g of guanidine trichloroacetate dissolved in 15 ml of ethanol | |
| (f) Gelatin dispersion of Acid Precursor (8) according to the present invention (the same as described in Example 1) | 10 ml |

The above components (a) to (f) were mixed and dissolved by heating and the mixture was coated on a polyethylene terephthalate film having a thickness of 180 μm at a wet layer thickness of 33 μm, and then dried. On the thus-formed layer, a solution having the following composition was coated at a wet layer thickness of 30 μm and dried to form a protective layer, whereupon Light-Sensitive Material C was prepared.

| | |
|---|---|
| (a) 10% Aqueous solution of gelatin | 30 ml |
| (b) Water | 70 ml |
| Light-Sensitive Material D | |
| (a) Light-sensitive silver iodobromide emulsion (the same as described in Example 1) | 25 g |
| (b) Dispersion of Dye Releasing Substance (1) (the same as described in Example 1) | 33 g |
| (c) 5% Aqueous solution of a compound having the following formula: | 10 ml |

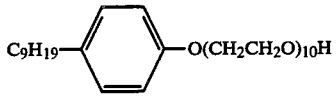

| | |
|---|---|
| (d) 10% Aqueous solution of a compound having the following formula: $N_2NSO_2N(CH_3)_2$ | 4 ml |
| (e) Solution containing 1.5 g of guanidine trichloroacetate dissolved in 15 ml of ethanol | |
| (f) Water | 10 ml |

The above components (a) to (f) were mixed and dissolved by heating and the mixture was coated on a polyethylene terephthalate film having a thickness of 180 μm at a wet layer thickness of 33 μm and dried. On the thus-formed layer, the protective layer was provided in the same manner as described in Light-Sensitive Material C.

Light-Sensitive Materials C and D thus-obtained were subjected to the same procedures as described in Example 1 and the results shown in Table 2 were obtained.

TABLE 2

| Light-Sensitive Material | Heating at 140° C. for 30 Seconds | | Heating at 140° C. for 60 seconds | |
|---|---|---|---|---|
| | Maximum Density | Minimum Density | Maximum Density | Minimum Density |
| C (Present Invention) | 1.90 | 0.15 | 2.05 | 0.25 |
| D (Comparison) | 2.00 | 0.20 | 2.30 | 0.70 |

As is apparent from the results shown in Table 2, the large effect on stopping development was obtained by using the aid precursor according to the present invention.

EXAMPLE 3

Light-Sensitive Materials E to L were prepared in the same manner as described in Light-Sensitive Material A of Example except using the acid precursors shown in Table 3 below in place of Acid Precursor (8), respectively, and subjected to the same procedures as described in Example 1. The results obtained are shown in Table 3.

TABLE 3

| Light-Sensitive Material | Acid Precursor | Heating at 140° C. for 30 Seconds | | Heating at 140° C. for 60 Seconds | |
|---|---|---|---|---|---|
| | | Maximum Density | Minimum Density | Maximum Density | Minimum Density |
| E (Present Invention) | (2) | 2.15 | 0.10 | 2.30 | 0.45 |
| F (Present Invention) | (4) | 2.00 | 0.08 | 2.10 | 0.15 |
| G (Present Invention) | (17) | 2.10 | 0.12 | 2.25 | 0.50 |
| H (Present Invention) | (21) | 2.05 | 0.14 | 2.15 | 0.25 |
| I (Present Invention) | (25) | 2.10 | 0.14 | 2.30 | 0.65 |
| J (Present Invention) | (36) | 1.95 | 0.08 | 2.05 | 0.15 |
| K (Present Invention) | (42) | 1.90 | 0.07 | 2.00 | 0.14 |

TABLE 3-continued

| Light-Sensitive Material | Acid Precursor | Heating at 140° C. for 30 Seconds Maximum Density | Heating at 140° C. for 30 Seconds Minimum Density | Heating at 140° C. for 60 Seconds Maximum Density | Heating at 140° C. for 60 Seconds Minimum Density |
|---|---|---|---|---|---|
| L (Present Invention) | (44) | 1.95 | 0.10 | 2.10 | 0.25 |
| B (Comparison) (same as in Example 1) | none | 2.15 | 0.15 | 2.35 | 0.85 |

From the results shown in Table 3 it is understood that the acid precursors according to the present invention exhibit an excellent effect on stopping development.

EXAMPLE 4

Dispersions of dye providing substances were prepared in the same manner as described in Example 1 except using the dye providing substances shown in Table 4 below in place of Dye Providing Substance (1), respectively.

Dye Providing Substance (2) 5 g Dispersion (I)
Dye Providing Substance (3) 7.5 g Dispersion (II)
Dye Providing Substance (4) 5 g Dispersion (III)

Dye Providing Substance (2):

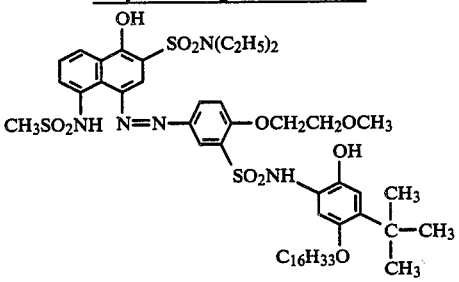

Dye Providing Substance (3):

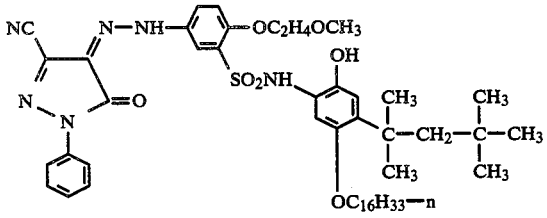

Dye Providing Substance (4):

-continued

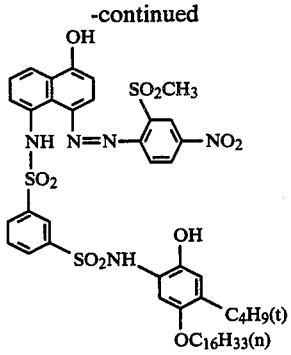

Light-Sensitive Materials M, O and Q were prepared in the same manner as described in Light-Sensitive Material A of Example 1 except using the dye providing substances as described above in place of Dye Providing Substance (1), respectively. Further, Light-Sensitive Materials, N, P and R were prepared in the same manner as described in Light-Sensitive Material B of Example 1 except using the dye providing substances as described above in place of Dye Providing Substance (1), respectively. These light-sensitive materials thus-obtained were subjected to the same procedures as described in Example 1 and the results shown in Table 4 were obtained.

TABLE 4

| Light-Sensitive Material | Dispersion of Dye Providing Substance | Acid Precursor | Heating at 140° C. for 30 Seconds Maximum Density | Heating at 140° C. for 30 Seconds Minimum Density | Heating at 140° C. for 60 Seconds Maximum Density | Heating at 140° C. for 60 Seconds Minimum Density |
|---|---|---|---|---|---|---|
| M (Present Invention) | Dispersion (I) (Magenta) | (8) | 2.10 | 0.15 | 2.20 | 0.25 |
| N (Comparison) | Dispersion (I) (Magenta) | none | 2.25 | 0.20 | 2.40 | 0.95 |
| O (Present Invention) | Dispersion (II) (Yellow) | (8) | 1.90 | 0.18 | 2.00 | 0.30 |
| P (Comparison) | Dispersion (II) (Yellow) | none | 1.95 | 0.22 | 2.10 | 0.90 |
| Q (Present Invention) | Dispersion (III) (Cyan) | (8) | 2.10 | 0.18 | 2.15 | 0.20 |
| R (Comparison) | Dispersion (III) (Cyan) | none | 2.30 | 0.20 | 2.40 | 0.85 |

From the results shown in Table 4 it is understood that the acid precursor according to the present invention exhibits an excellent effect on stopping development.

EXAMPLE 5

In this example the base precursors as described below were used in place of guanidine trichloroacetate in Example 1, respectively.

Base Precursor I:

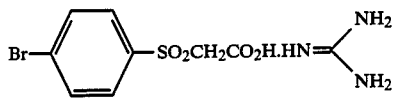

Base Precursor II:

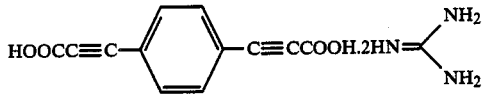

Light-Sensitive Material S:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of dye providing substance (the same as described in Example 1) | 33 g |
| (d) | 5% Aqueous solution of a compound having the following formula: | 10 ml |

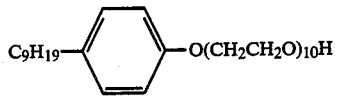

| | | |
|---|---|---|
| (e) | 10% Aqueous solution of a compound having the following formula: $N_2NSO_2N(CH_3)_2$ | 4 ml |
| (f) | 8% Water-methanol (1/1 by volume) solution of Base Precursor I | 32 ml |
| (g) | Gelatin dispersion of Acid Precursor (8) according to the present invention (the same as described in Example 1) | 10 ml |

The above components (a) to (g) were mixed and dissolved by heating and the mixture was coated on a polyethylene terephthalate film having a thickness of 180 μm at a wet layer thickness of 38 μm, and then dried. On the thus-formed layer, a solution having the following composition was coated at a wet layer thickness of 30 μm and dried to form a protective layer, whereupon Light-Sensitive Material S was prepared.

| | | |
|---|---|---|
| (a) | 10% Aqueous solution of gelatin | 30 ml |
| (b) | Water | 70 ml |

Light-Sensitive Material T:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of dye providing substance (the same as described in Example 1) | 33 g |
| (d) | 5% Aqueous solution of a compound having the following formula: | 10 ml |

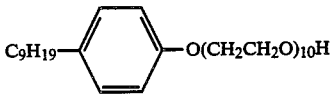

| | | |
|---|---|---|
| (e) | 10% Aqueous solution of a compound having the following formula: $N_2NSO_2N(CH_3)_2$ | 4 ml |
| (f) | 8% Water-methanol (1/1 by volume) solution of Base Precursor I | 32 ml |
| (g) | Water | 10 ml |

The above components (a) to (g) were mixed and dissolved by heating and the mixture was coated on a polyethylene terephthalate film having a thickness of 180 μm at a wet layer thickness of 38 μm, and then dried. On the thus-formed layer, the protective layer was provided in the same manner as described in Light-Sensitive Material S.

Light-Sensitive Material U:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of dye providing substance (the same as described in Example 1) | 33 g |
| (d) | 5% Aqueous solution of a compound having the following formula: | 10 ml |

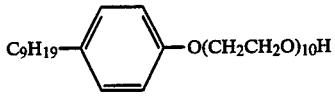

| | | |
|---|---|---|
| (e) | 10% Aqueous solution of a compound having the following formula: $H_2NSO_2N(CH_3)_2$ | 4 ml |
| (f) | 8% Water-methanol (1/1 by volume) solution of Base Precursor II | 32 ml |
| (g) | Gelatin dispersion of Acid Precursor (3) according to the present invention (the same as described in Example 1) | 10 ml |

The above components (a) to (g) were mixed and dissolved by heating and the mixture was coated on a polyethylene terephthalate film having a thickness of 180 μm at a wet layer thickness of 38 μm, and then dried. On the thus-formed layer, a solution having the following composition was coated at a wet layer thickness of 30 μm and dried to form a protective layer, whereupon Light-Sensitive Material U was prepared.

Light-Sensitive Material V:

| | | |
|---|---|---|
| (a) | Silver iodobromide emulsion (the same as described in Example 1) | 20 g |
| (b) | Silver benzotriazole emulsion (the same as described in Example 1) | 10 g |
| (c) | Dispersion of dye providing substance (the same as described in Example 1) | 33 g |
| (d) | 5% Aqueous solution of a compound having the following formula: | 10 ml |

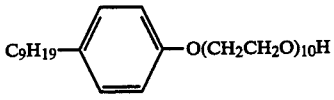

| | | |
|---|---|---|
| (e) | 10% Aqueous solution of a compound having the following formula: $H_2NSO_2N(CH_3)_2$ | 4 ml |
| (f) | 8% Water-methanol (1/1 by volume) solution of Base Precursor II | 32 ml |
| (g) | Water | 10 ml |

The above components (a) to (g) were mixed and dissolved by heating and the mixture was coated on a polyethylene terephthalate film having a thickness of 180 μm at a wet layer thickness of 33 μm, and then dried. On the thus-formed layer, the protective layer was provided in the same manner as described in Light-Sensitive Material U.

Light-Sensitive Materials S, T, U and V thus-obtained were subjected to the same procedures as described in Example 1 and the results shown in Table 5 were obtained.

TABLE 5

| Light Sensitive Material | Base Precursor | Acid Precursor | Heating at 140° C. for 30 Seconds | | Heating at 140° C. for 60 Seconds | |
|---|---|---|---|---|---|---|
| | | | Maximum Density | Minimum Density | Maximum Density | Minimum Density |
| S (Present Invention) | I | (8) | 1.70 | 0.07 | 1.74 | 0.13 |
| T (Comparison) | I | none | 1.80 | 0.12 | 2.00 | 0.48 |
| U (Present Invention) | II | (8) | 2.07 | 0.09 | 2.10 | 0.20 |
| V (Comparison) | II | none | 2.15 | 0.14 | 2.30 | 0.65 |

As is apparent from the results shown in Table 5, the large effect on stopping development was obtained by using the acid precursor according to the present invention.

EXAMPLE 6

| Light-Sensitive Material W: | |
|---|---|
| (a) Silver iodobromide emulsion (the same as described in Example 1) | 20 g |
| (b) Silver benzotriazole emulsion (the same as described in Example 1) | 10 g |
| (c) Dispersion of dye providing substance (the same as described in Example 1) | 33 g |
| (d) 5% Aqueous solution of a compound having the following formula: | 10 ml |

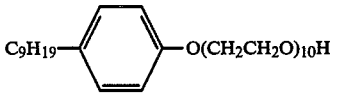

| | |
|---|---|
| (e) 10% Aqueous solution of a compound having the following formula: $H_2NSO_2N(CH_3)_2$ | 4 ml |
| (f) Solution containing 0.8 g of guanidine trichloroacetate (a base precursor) dissolved in 8 ml of ethanol | |
| (g) Water | 18 ml |

The above components (a) to (g) were mixed and dissolved by heating and the mixture was coated on a polyethylene terephthalate film having a thickness of 180 μm at a wet layer thickness of 33 μm, and then dried. On the thus-formed layer, a solution having the following composition was coated at a wet layer thickness of 30 μm and dried to form a protective layer, whereupon Light-Sensitive Material X was prepared.

| | |
|---|---|
| (a) 10% Aqueous solution of gelatin | 30 ml |
| (b) Water | 61 ml |
| (c) Solution containing 0.9 g of guanidine trichloroacetate dissolved in 9 ml of ethanol | |

Light-Sensitive Materials W and X thus-obtained were subjected to the same procedures as described in Example 1 and the results shown in Table 6 were obtained.

TABLE 6

| Light-Sensitive Material | Maximum Density | Minimum Density | Maximum Density | Minimum Density |
|---|---|---|---|---|
| W (Present Invention) | 2.05 | 0.10 | 2.15 | 0.16 |
| X (Comparison) | 2.10 | 0.12 | 2.30 | 0.78 |

It is understood from the results shown in Table 6 that the acid precursor according to the present invention has a significant effect on stopping development when it is incorporated into the protective layer of the light-sensitive material.

EXAMPLE 7

A mixture of 10 g of Dye Providing Substance (5) having the structure shown below, 0.5 g of succinic acid 2-ethylhexyl ester sulforic acid sodium salt, 10 g of tricresyl phosphate and 20 ml of cyclohexanone was dissolved by heating at 60° C. to prepare a uniform solution. The solution was mixed with 100 g of a 10% aqueous solution of lime-processed gelatin by stirring and the mixture was dispersed by means of a homogenizer to prepare a dispersion of dye providing substance.

Dye Providing Substance (5):

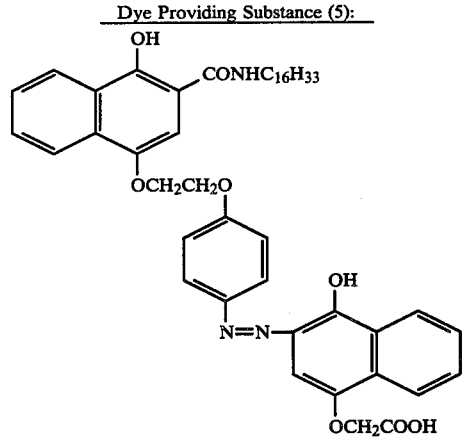

Light-Sensitive Material 701 was prepared in the following manner.

| | |
|---|---|
| (a) Silver iodobromide emulsion (the same as described in Example 1) | 5.5 g |
| (b) 10% Aqueous solution of gelatin | 0.5 g |
| (c) Dispersion of dye providing substance (described above) | 2.5 g |
| (d) 10% Ethanol solution of guanidine trichloroacetate | 1 ml |
| (e) 10% Methanol solution of 2,6-dichloro-4-aminophenol | 0.5 ml |
| (f) 5% Aqueous solution of a compound having the following formula: | 1 ml |

-continued

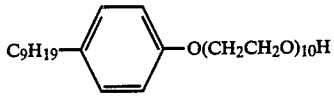

| | | |
|---|---|---|
| (g) | Gelatin dispersion of Acid Precursor (8) (the same as described in Example 1) | 0.5 g |
| (h) | Water | 6 ml |

The above components (a) to (h) were mixed and dissolved by heating and the mixture was coated on a polyethylene terephthalate film at a wet layer thickness of 85 m. On the thus-formed layer, a protecting layer containing 1.5 g/m$^2$ of gelatin was provided, whereupon Light-Sensitive Material 701 was prepared.

Light-Sensitive Material 701 thus-obtained was subjected to light exposure and processing in the same manner as described in Example 1 except that the heating time was changed to as shown below and the results shown in Table 7 were obtained.

TABLE 7

| Light-Sensitive Material | Heating at 140° C. for 30 Seconds | | Heating at 140° C. for 60 seconds | |
|---|---|---|---|---|
| | Maximum Density | Minimum Density | Maximum Density | Minimum Density |
| 701 | 1.75 | 0.11 | 1.82 | 0.18 |

From the results shown in Table 7 it can be recognized that the acid precursor according to the present invention also exhibits remarkable effects in the light-sensitive material containing a dye providing substance which releases a dye upon the coupling reaction with the oxidation product of a developing agent.

EXAMPLE 8

A mixture of 5 g of Dye Providing Substance (6) having the structure shown below, 4 g of an electron doner having the structure shown below, 0.5 g of succinic acid 2-ethylhexyl ester sulfonic acid sodium salt, 10 g of tricresyl phosphate and 20 ml of cyclohexanone was dissolved by heating at about 60° C. Then, the same procedure as described in Example 7 was carried out to prepare a dispersion of dye providing substance capable of being reduced.

Dye Providing Substance (6):

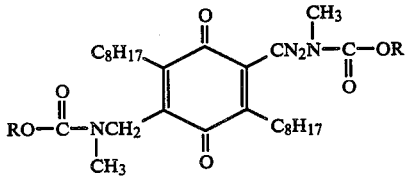

wherein R is

-continued

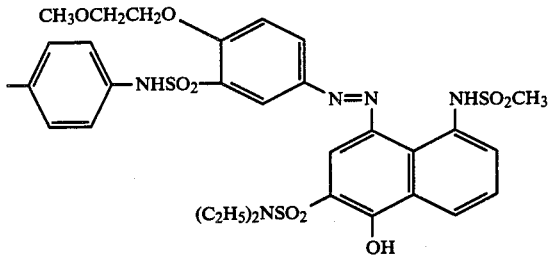

Electron Donor:

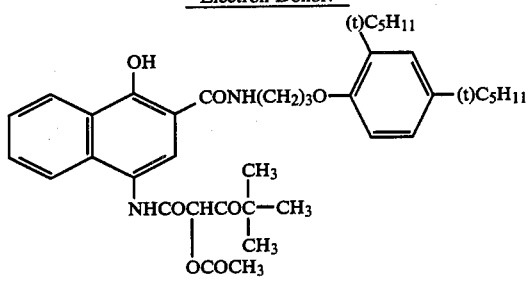

Light-Sensitive Material 801 was prepared in the same manner as described for Light-Sensitive Material 701 in Example 7, except for using the above-described dispersion of dye providing substance capable of being reduced in place of the dispersion of Dye Providing Substance (5).

Light-Sensitive Material 801 thus-obtained was subjected to light exposure and processing in the same manner as described in Example 7 and the results shown in Table 8 were obtained.

TABLE 8

| Light-Sensitive Material | Heating at 140° C. for 30 Seconds | | Heating at 140° C. for 60 seconds | |
|---|---|---|---|---|
| | Maximum Density | Minimum Density | Maximum Density | Minimum Density |
| 801 | 1.53 | 0.14 | 1.60 | 0.20 |

From the results shown in Table 8 it can be recognized that the acid precursor according to the present invention also exhibits the good effect in the light-sensitive material containing a dye providing substance which is capable of being reduced and providing a positive image with respect to a silver image.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a support having thereon at least (1) a light-sensitive silver halide emulsion, (2) a dye providing substance which releases a dye having a different diffusibility from that of the dye providing substance in correspondence or countercorrespondence to the light-sensitive silver halide when the light-sensitive silver halide is reduced under high temperature conditions, and (3) an organic acid precursor containing a structural moiety bonded to carbon atoms that is represented by formula (I), and wherein said organic acid precursor is present in an amount effective to provide an image having a high S/N ratio and high density.

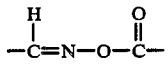

(I)

2. A heat-developable color light-sensitive material as in claim 1, wherein the organic acid precursor is a compound represented by formula (A)

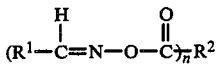

(A)

wherein $R^1$ represents a substituent selected from an alkyl group, a substituted alkyl group, a cycloalkyl group, an aralkyl group, an alkenyl group, an aryl group, a substituted aryl group, and a heterocyclic group; $R^2$ represents a mono-, di- or tri-valent group derived from an alkyl group, a substituted alkyl group, a cycloalkyl group, an aralkyl group, an aryl group, a substituted aryl group, a heterocyclic group; and n represents an integer of 1, 2 or 3, and wherein said organic acid precursor is present in an amount effective to provide an image having a high S/N ratio and high density.

3. A heat-developable color light-sensitive material as in claim 2, wherein the alkyl group represented by $R^1$ and $R^2$ is straight chain or branched chain alkyl groups containing from 1 to 18 carbon atoms.

4. A heat-developable color light-sensitive material as in claim 2, wherein a substituent for the substituted alkyl group represented by $R^1$ or $R^2$ is selected from a halogen atom, an alkoxy group, a cyano group, a substituted or unsubstituted carbamoyl group, a hydroxy group, and a carboxy group.

5. A heat-developable color light-sensitive material as in claim 2, wherein the cycloalkyl group represented by $R^1$ and $R^2$ is a 5-membered or 6-membered cycloalkyl group containing from 5 to 10 carbon atoms.

6. A heat-developable color light-sensitive material as in claim 2, wherein the aryl group represented by $R^1$ or $R^2$ is an aryl group containing from 6 to 18 carbon atoms.

7. A heat-developable color light-sensitive material as in claim 2, wherein a substituent for the substituted aryl group represented by $R^1$ or $R^2$ is selected from a substituted or unsubstituted alkyl group, a substituted or unsubstituted alkoxy group, a substituted or unsubstituted aryl group, a halogen atom, a disubstituted amino group substituted with alkyl or aryl groups, an acylamino group, a sulfonylamino group, a cyano group, a nitro group, an alkyl- or aryl-thio group, an alkyl- or aryl-sulfonyl group, an oxycarbonyl group, a carbonyloxy group, a substituted or unsubstituted carbamoyl group, and a substituted or unsubstituted sulfamoyl group.

8. A heat-developable color light-sensitive material as in claim 2, wherein the heterocyclic group represented by $R^1$ or $R^2$ is a substituted heterocyclic group having a substituent selected from a substituted or unsubstituted alkyl group, a substituted or unsubstituted alkoxy group, a substituted or unsubstituted aryl group, a halogen atom, a disubstituted amino group substituted with alkyl or aryl groups, an acylamino group, a sulfonylamino group, a cyano group, a nitro group, an alkyl- or aryl-thio group, an alkyl- or aryl-sulfonyl group, an oxycarbonyl group, a carbonyloxy group, a substituted or unsubstituted carbamoyl group, and a substituted or unsubstituted sulfamoyl group.

9. A heat-developable color light-sensitive material as in claim 2, wherein $R^1$ and $R^2$ each represents an aryl group, a substituted aryl group, or a heterocyclic group.

10. A heat-developable color light-sensitive material as in claim 9, wherein $R^1$ and $R^2$ each represents a phenyl group, a substituted phenyl group, a naphthyl group, or a substituted naphthyl group.

11. A heat-developable color light-sensitive material as in claim 1, wherein an amount of the organic acid precursor is not more than 50% by weight based on the weight of the coated layer.

12. A heat-developable color light-sensitive material as in claim 1, wherein the dye providing substance is a compound represented by formula (C I)

$$(\text{Dye-X})_q\text{Y} \qquad \text{(C I)}$$

wherein Dye represents a dye which becomes mobile when it is released from the molecule of the compound represented by formula (C I); X represents a simple bond or a connecting group; Y represents a group which releases Dye in correspondence or countercorrespondence to light-sensitive silver salts having a latent image distributed imagewise, the difusibility of Dye released being different from that of the compound represented by formula (C I) and q represents an integer of 1 or 2.

13. A heat-developable color light-sensitive material as in claim 1, wherein the light-sensitive material further contains a reducing substance.

14. A heat-developable color light-sensitive material as in claim 1, wherein said acid precursor is stable at a temperature below 50° C. but when heated during development to a temperature of 80° C. to 180° C. releases an acid to stop development at an appropriate time.

15. A heat-developable color light-sensitive material as in claim 1, wherein said acid precursor is stable at a temperature below 50° C. but when heated during development to a temperature of 100° C. to 150° C. releases an acid to stop development at an appropriate time.

16. A heat-developable color light-sensitive material as in claim 14, wherein the acid precursor decomposes not more than 80% based on the total amount thereof added until the appropriate time of development.

17. A heat-developable color light-sensitive material as in claim 14, wherein the acid precursor decomposes not more than 50% based on the total amount thereof added until the appropriate time of development.

18. A heat-developable color light-sensitive material as in claim 14, wherein the acid precursor decomposes not more than 20% based on the total amount thereof added until the appropriate time of development.

* * * * *